US011604436B2

(12) United States Patent
Junod et al.

(10) Patent No.: US 11,604,436 B2
(45) Date of Patent: Mar. 14, 2023

(54) SYSTEM FOR FIXING A TIMEPIECE MOVEMENT IN A WATCH CASE

(71) Applicant: ROLEX SA, Geneva (CH)

(72) Inventors: Benoit Junod, Contamine-sur-Arve (FR); James Rejzner, Saint-Julien-en-Genevois (FR)

(73) Assignee: ROLEX SA, Geneva (CH)

( * ) Notice: Subject to any disclaimer, the term of this patent is extended or adjusted under 35 U.S.C. 154(b) by 573 days.

(21) Appl. No.: 16/184,113

(22) Filed: Nov. 8, 2018

(65) Prior Publication Data

US 2019/0146417 A1 May 16, 2019

(30) Foreign Application Priority Data

Nov. 13, 2017 (EP) ..... 17201348
Nov. 13, 2017 (EP) ..... 17201351

(51) Int. Cl.
*G04B 37/05* (2006.01)

(52) U.S. Cl.
CPC ..... *G04B 37/05* (2013.01)

(58) Field of Classification Search
CPC ..... G04B 37/05; G04B 37/052; G04B 37/00
See application file for complete search history.

(56) References Cited

U.S. PATENT DOCUMENTS 3,633,356 A 1/1972 Kitazima et al.
3,855,786 A 12/1974 Yamamoto
3,911,669 A 10/1975 Burkle
2002/0027834 A1 3/2002 Thalheim
2006/0164924 A1* 7/2006 Arai ..... G04B 37/05 368/281
2008/0101162 A1* 5/2008 Born ..... G04B 15/08 368/132
2013/0128707 A1* 5/2013 Mertenat ..... G04B 29/02 368/309
2013/0286798 A1 10/2013 Cattaneo et al.
2014/0169144 A1* 6/2014 Briswalter ..... G04B 37/103 368/319

(Continued)

FOREIGN PATENT DOCUMENTS

DE 2 316 784 A1 10/1974
EP 1 182 522 A1 2/2002

(Continued)

OTHER PUBLICATIONS

European Search Report and Written Opinion dated Apr. 26, 2018 issued in counterpart application No. EP17201348; w/ English machine translation (16 pages).

(Continued)

*Primary Examiner* — Sean Kayes
(74) *Attorney, Agent, or Firm* — WHDA, LLP

(57) ABSTRACT

The system (10) for fixing a timepiece movement (2) to a watch case (30) element (3) includes at least one clamp (1), in particular at least two clamps, preferably three clamps or four clamps, which is intended to come into contact firstly with the movement and secondly with the watch case element, and a device (2*a'*; 3*a*') for modifying the stiffness of the at least one clamp, particularly for modifying the bending stiffness of the at least one clamp, when the movement is fixed and/or displaced relative to the watch case element.

19 Claims, 11 Drawing Sheets

(56) References Cited

U.S. PATENT DOCUMENTS

2016/0037876 A1* 2/2016 Perkins ..... A44B 11/263
224/164

FOREIGN PATENT DOCUMENTS

| | | | |
|---|---|---|---|
| FR | 2 211 690 | A1 | 7/1974 |
| JP | S55-73877 | U | 5/1980 |
| JP | 2000-111663 | A | 4/2000 |
| JP | 2000-162332 | A | 6/2000 |
| JP | 2002-174687 | A | 6/2002 |
| JP | 2013-543983 | A | 12/2013 |

OTHER PUBLICATIONS

European Search Report and Written Opinion dated Apr. 25, 2018 issued in second priority application No. EP17201351, counterpart of co-pending U.S. Appl. No. 16/184,116; w/ English machine translation (14 pages) D1-D4 cited in the EP search report of the EP counterpart of the co-pending application are not listed in this IDS since they were already listed in the IDS filed concurrently with the US application.

Office Action dated Jul. 5, 2022, issued in counterpart JP application No. 2018-212663, with English translation. (12 pages).

Office Action dated Jul. 5, 2022, issued in counterpart JP application No. 2018-212662, with English translation. (17 pages).

* cited by examiner

| Co | l [mm] | F [N] | d [mm] | Def [mm] |
|---|---|---|---|---|
| A | 0.12 | 123 | 0.291 | 0.295 |
| B | 0.12 | 182 | 0.078 | 0.096 |
| C | 0.12 | 192 | 0.074 | 0.120 |
| D | 0.12 | 174 | 0.011 | 0.048 |

SYSTEM FOR FIXING A TIMEPIECE MOVEMENT IN A WATCH CASE

This application claims priority of European patent application No. N° EP17201348.4 filed Nov. 13, 2017, which is hereby incorporated by reference herein in its entirety, and this application claims priority of European patent application No. N° EP17201351.8 filed Nov. 13, 2017, which is hereby incorporated by reference herein in its entirety.

The invention relates to a system for fixing a timepiece movement to a watch case element. The invention also relates to a timepiece unit comprising such a system. The invention further relates to timepiece comprising such a system or such a unit. The invention finally relates to a method of operating such a system or such a unit or such a timepiece.

In general, two or three casing clamps are used to assemble or fix a timepiece movement within a watch case, particularly within a middle.

When assembling the movement within the case, each casing clamp is inserted into a cutout formed on the internal circumference of the middle, then fixed to the movement via a fixing means.

This cutout can particularly be shaped such that the clamp can cause a suitable prestress force, which makes it possible to press the movement against the middle of the case such as to meet predefined criteria. One criterion can be, for example, a minimization of the range of travel of the movement for a given intensity of impact, as well as clamp given geometry and material, without the risk of plastic deformation of the clamps.

FIGS. 1 and 2 illustrate a construction of such a clamp casing device. At least one clamp 1* is pressed against planar and parallel surfaces 2*a, 3*a, which are associated with a movement 2* and with a middle 3* of a case 30*, respectively. The clamp 1* is thus elastically deformed when assembling the movement such that the elastic restoring force of the clamp holds a surface 2*b of the movement 2* against a surface 3*b of the middle 3*. The clamp is kept on the movement in this case by a screw 4*.

However, such a solution can present problems. Indeed, there is a risk of plastic deformation of the clamps during assembly and/or under the effect of an impact. This can lead to an undesired loss of contact between the movement and the middle, or to undesired risks of removal of the clamps.

The aim of the invention is to provide a system for fixing a timepiece movement in a watch case making it possible to overcome the aforementioned disadvantages and improve the devices known from the prior art. In particular, the invention proposes a fixing system, the reliability and robustness of which is improved with respect to the systems known from the prior art.

According to a first aspect of the invention, a system for fixing a timepiece movement is determined by the following definitions.

1. A system for fixing a timepiece movement to a watch case element, the system comprising:
   - at least one clamp, in particular at least two clamps, preferably three clamps or four clamps, which is intended to come into contact firstly with the movement and secondly with the watch case element, and
   - a device for modifying the stiffness of the at least one clamp, particularly for modifying the bending stiffness of the at least one clamp, when the movement is fixed and/or displaced relative to the watch case element.
2. The system according to the definition 1, wherein the device for modifying the stiffness of the at least one clamp is arranged such that the bent length of the at least one clamp is modified, particularly such that the bent length of the at least one clamp is reduced, when the movement is fixed to the watch case element or displaced relative to the watch case element from a rest position in which a first surface of the movement abuts against a second surface of the case element.
3. The system according to the definition 1 or 2, wherein the bearing force or the contact of a first bent end of the at least one clamp against the movement and/or the bearing force or the contact of a second bent end of the at least one clamp against the case element is (are) modified when the movement is fixed to the watch case element or displaced relative to the watch case element from a rest position in which a first surface of the movement abuts against a second surface of the case element.
4. The system according to one of the definitions 1 to 3, wherein the device for modifying the stiffness of the at least one clamp comprises, in the state where the movement is fixed to the case element and the movement being in a rest position in which a first surface of the movement abuts against a second surface of the case element, a first clearance between the clamp and a point of the movement against which the clamp can come into contact via bending of the clamp, the value of the first clearance being less than Lc1, or less than Lc1/3, or less than Lc1/4 and/or the value of the first clearance is greater than Lc1/60, or greater than Lc1/30, with Lc1 being the length of a projection in the plane of the movement of a third surface against which the clamp can bear and the length Lc1 being between Lf/10 and Lf with Lf being the bent clamp length, and/or the device for modifying the stiffness of the at least one clamp comprises, in the state where the movement is fixed to the case element and the movement being in a rest position in which a first surface of the movement abuts against a second surface of the case element, a second clearance between the clamp and a point of the case element against which the clamp can come into contact via bending of the clamp, the value of the second clearance being less than Lc2, or less than Lc2/3, or less than Lc2/4 and/or the value of the second clearance is greater than Lc2/60, or greater than Lc2/30, with Lc2 being the length of a projection in the plane of the movement of a fifth surface against which the clamp can bear and the length Lc2 being between Lf/10 and Lf with Lf measured in the rest state.
5. The system according to one of the definitions 1 to 4, wherein the device for modifying the stiffness of the at least one clamp comprises:
   - a third surface forming a first nonzero angle with a fourth surface against which the clamp bears when the movement is in a rest position in which a first surface of the movement abuts against a second surface of the case element, and/or
   - a fifth surface forming a second nonzero angle with a sixth surface against which the clamp bears when the movement is in a rest position in which a first surface of the movement abuts against a second surface of the case element.
6. The system according to the definition 5, wherein the first angle is less than 45°, or less than 20°, or less than 15°, or less than 10°, and/or is greater than 1°, or greater than 2° and/or the second angle is less than 45°, or less than 20°, or less than 15°, or less than 10° and/or is greater than 1°, or greater than 2°.
7. The system according to the definition 5 or 6, wherein the first surface is planar and/or the second surface is planar and/or the third surface is planar and/or the fourth surface is planar and/or the fifth surface is planar and/or the sixth surface is planar.

8. The system according to the definition 5 or 6, wherein the third surface is rounded, particularly the third surface is a cylinder portion, and/or the fifth surface is rounded, particularly the fifth surface is a cylinder portion.
9. The system according to one of the definitions 1 to 8, wherein the at least one clamp comprises a cross-section, the second moment of area of which changes along a longitudinal axis, particularly by change in the width and/or of the thickness and/or such that the cross-section is such that the profile of the maximum stresses is constant or at least substantially constant over at least part of the length of the at least one clamp, particularly over at least half of the length of said clamp.
10. The system according to one of the definitions 1 to 9, wherein the at least one clamp is made of a superelastic alloy and/or of a shape memory alloy, particularly of a nickel-titanium alloy such as Nitinol or the at least one clamp is made of a nickel alloy.
11. The system according to one of the definitions 1 to 10, wherein the at least one clamp comprises an element for fixing to the movement or to the case element, particularly a screw passage hole.

According to the first aspect of the invention, a timepiece unit is determined by the following definitions.

12. A timepiece unit, particularly a timepiece movement and/or a watch case element or a watch case, comprising a system according to one of the definitions 1 to 11.
13. The timepiece unit according to the definition 12, wherein the watch case element is a middle.
14. The timepiece unit according to the definition 12 or 13, wherein the third surface is produced on the movement and/or the fourth surface is produced on the case element.
15. The timepiece unit according to the definition 12 or 13, wherein the case element comprises a casing ring and/or the fourth surface is produced at least partially on a casing ring or the movement comprises a casing ring and/or the third surface is produced at least partially on a casing ring.

According to the first aspect of the invention, a timepiece is determined by the following definition.

16. A timepiece, particularly a wristwatch, comprising a unit according to one of the definitions 12 to 15 and/or or a system according to one of the definitions 1 to 11.

According to a second aspect of the invention, a system for fixing a timepiece movement is determined by the following definitions.

17. A system for fixing a timepiece movement to a watch case element, the system comprising at least one clamp, in particular at least two clamps, preferably three clamps or four clamps, which is intended to come into contact firstly with the movement and secondly with the watch case element, the at least one clamp being made of a superelastic alloy and/or of a shape memory alloy, particularly of a nickel-titanium alloy such as Nitinol.
18. The system according to the definition 17, wherein the at least one clamp comprises a cross-section, the second moment of area of which changes along a longitudinal axis, particularly by change in the width and/or in the thickness and/or such that the cross-section is such that the profile of the maximum stresses is constant or substantially constant over at least part of the length of the at least one clamp, particularly over at least half of the length of the clamp.
19. The system according to one of the definitions 17 to 18, wherein the at least one clamp comprises an element for fixing to the movement or to the watch case element, particularly a screw passage hole.
20. The system according to one of the definitions 17 to 19, wherein the thickness of the at least one clamp is greater than or equal to 0.5 mm.
21. The system according to one of the definitions 17 to 20, wherein the bent length of the at least one clamp is less than or equal to 1.35 mm.

According to the second aspect of the invention, a timepiece unit is determined by the following definition.

22. A timepiece unit, particularly a timepiece movement or a watch case element, comprising a system according to one of the definitions 17 to 21.

According to the second aspect of the invention, a timepiece is determined by the following definition.

23. A timepiece, particularly a wristwatch, comprising a unit according to the definition 22 and/or a system according to one of the definitions 17 to 21.

Unless logically or technically incompatible, the features of the first and second aspects can be combined.

The appended figures show, by way of examples, two embodiments of a timepiece according to the invention.

Figure 3:
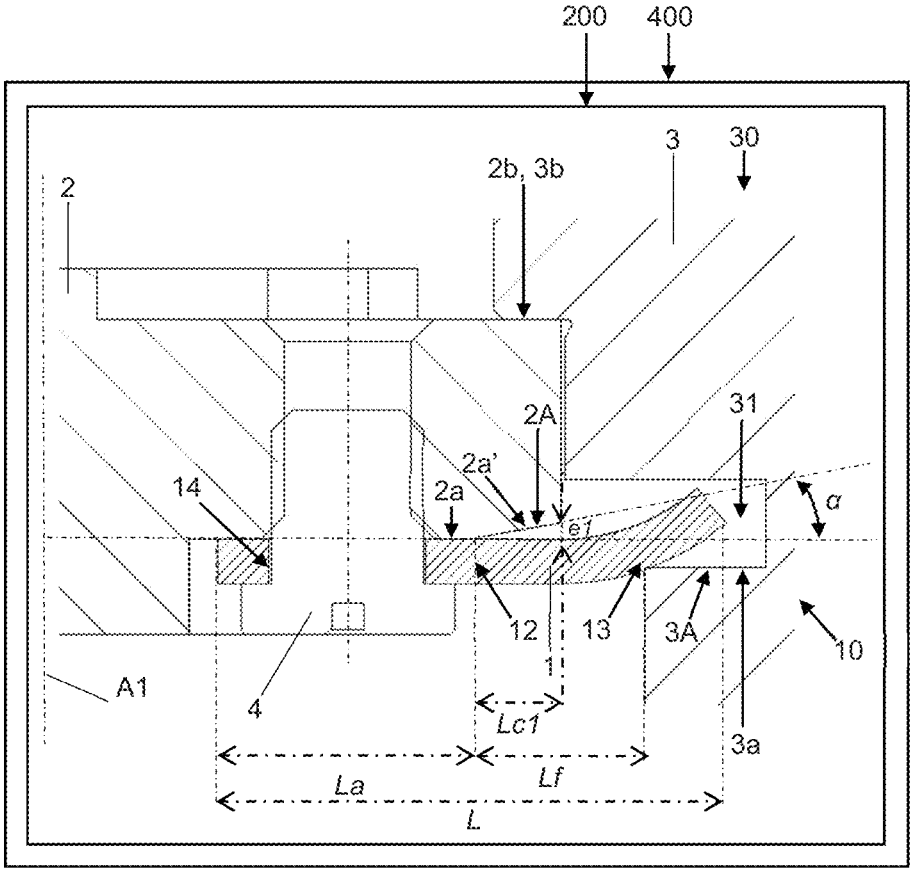
FIGS. 3 and 4 are views of a first embodiment of a timepiece in two states.
Figure 4:
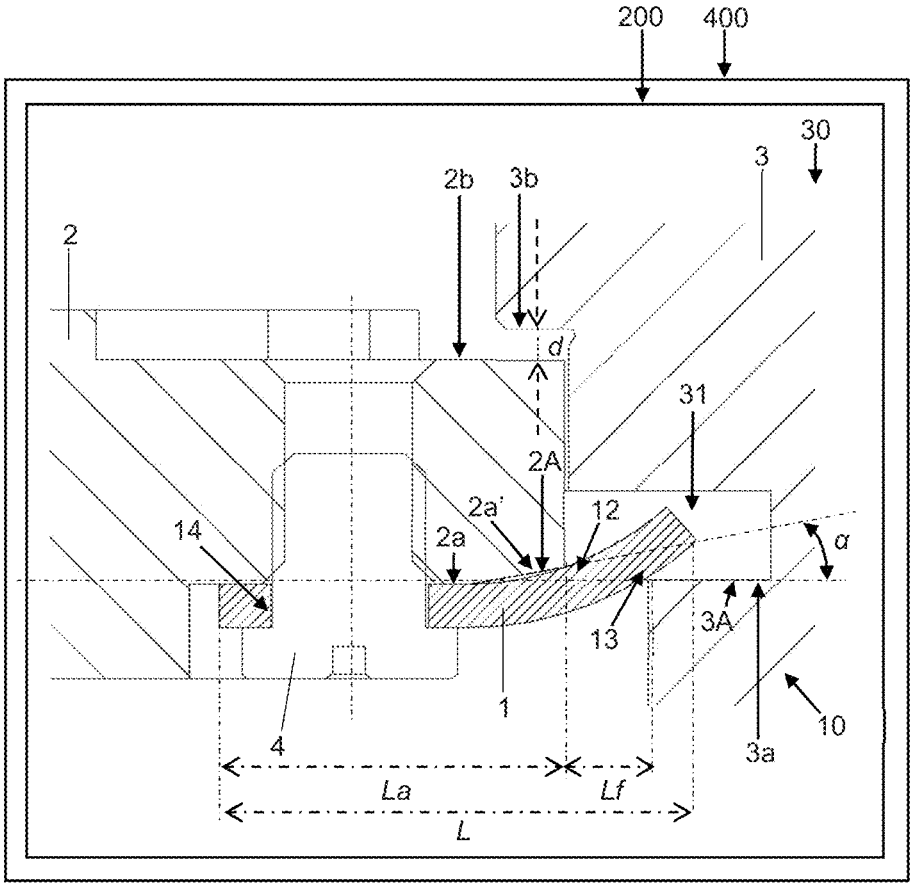

A first embodiment of a timepiece 400 is described hereafter with reference to FIGS. 3 and 4. The timepiece is, for example, a watch, in particular a wristwatch. The timepiece comprises a watch housing or a watch case 30 comprising a middle 3. The watch case 30 contains a timepiece movement 2. The movement can be a mechanical movement or an electronic movement.

The timepiece movement 2 and/or an element 3 of the watch case and/or the watch case 30 can form or make up part of a timepiece unit 200 comprising or contributing to a system 10 for fixing the timepiece movement 2 to a watch case 30 element 3. The watch case element can be, for example, a middle or an enlarging ring.

The system 10 for fixing the timepiece movement 2 to the watch case element 3 comprises:

at least one clamp 1, in particular at least two clamps, preferably three clamps or four clamps, which is intended to come into contact firstly with the movement and secondly with the watch case element, and a device 2*a*' for modifying the stiffness of the at least one clamp, particularly for modifying the bending stiffness of the at least one clamp, when fixing the movement to the case element and/or when the movement is displaced relative to the watch case element.

The system has the feature of using elastic casing clamps, the stiffnesses of which can vary as a function of the load which is applied thereto, particularly during the displacement of the timepiece movement with respect to the watch case in the instance of impact or when assembling the movement to the case. According to another aspect, the system has the feature of implementing casing that is particularly stiff and largely insensitive to the variations in manufacturing and/or assembling tolerances. Such an embodiment has the advantage of proposing a long-lasting fixing system, which particularly prevents the risks of plastic deformation of the clamps contributing to the assembly and/or the risks of untimely removal of the fixing means for said clamps, particularly in the instance of impact of the watch.

The stiffness of a clamp can be characterized by the intensity of the bend thereof following load or a given effort. It is possible to modulate the stiffness of a clamp by modifying the active length thereof and/or by modifying the bearing points or surfaces thereof when it is loaded. The device for modifying the stiffness takes advantage of this possibility.

The device for modifying the stiffness of the at least one clamp is preferably arranged such that the bent length of the at least one clamp is modified, particularly such that the bent length of the at least one clamp is reduced, when the movement is fixed to the watch case element or displaced relative to the watch case element from a rest position in which a first surface 2*b* of the movement abuts against a second surface 3*b* of the case element. The first surface 2*b* is, for example, a face of the movement. The second surface 3*b* is, for example, a supporting surface produced in the case, for example in the middle.

In the state where the movement is assembled in the case, at least one clamp 1 is pressed against a surface 2A of the movement. The at least one clamp bears against a surface 3A of the case, particularly against an end of a surface 3A of the case. The surface 3A is, for example, a supporting area of a cutout 31 or of a recess 31 produced in the case element, particularly in the middle. The clamp 1 is thus elastically deformed when assembling the movement such that the elastic restoring force of the clamp holds the surface 2*b* of the movement 2 against the surface 3*b* of the case 3. The clamp is kept on the movement in this case by a screw 4. The screw 4 is, for example, screwed into an internal thread provided in the movement. The screw passes through a hole 14 made in the clamp 1. The head of the screw bears against a surface of the clamp 1. The first and second surfaces 2*b* and 3*b* are planar, for example. They are preferably perpendicular to an axis A1 of the movement. This axis A1 is perpendicular to a plane of the movement, particularly to a plane of a frame of the movement and/or the axis A1 is parallel to the direction along which the movement is inserted into the watch case element 3.

The bending active length Lf of the clamp corresponds to a limited portion of the total length L of the clamp. The bending active length Lf extends between a first zone forming a first bent end 12 and a second zone forming a second bent end 13. The first end 12 is located at the contact boundary between the movement and the clamp. The second end 13 is located at the contact boundary between the case and the clamp. The length La is the length of the clamp which is bearing on the movement. This length can possibly be discontinuous. It extends between the end boundaries where the clamp 1 bears on the movement.

In the first embodiment, the bearing surface 2A of the movement includes at least one surface portion 2*a*' forming an angle α with the frame of the movement. This portion 2*a*' is adjacent to a portion 2*a* against which the screw 4 presses the clamp against the frame of the movement. The portion 2*a* is, for example, planar. Thus, the surface portion 2*a*' forms the nonzero angle α with the portion 2*a* against which the clamp bears when the movement is in a rest position in which the first surface 2*b* of the movement abuts against the second surface 3*b* of the case element.

When assembling the movement 2 within the case 30, the clamp 1 is elastically deformed via the contact with all or part of the surface 3A under the action of the screw 4. The clamp is elastically deformed over an axial distance of interference corresponding to the interference of matter between the clamp and the case before elastic deformation of the clamp. Once the movement has been cased, the clamp is pressed against the surface 2A and held in a pre-tension state via the screw 4. In the various configurations, the bending length Lf of the clamp is particularly defined by the geometry of the surface 2A. Within the specific construction illustrated in FIG. 3, Lf~La/1.5, which gives the clamp a first stiffness that it keeps until the clamp comes back into contact with the portion 2*a*', particularly during an impact the intensity of which is greater than a threshold given value. When this threshold value is reached, as shown in FIG. 4, the movement is displaced axially by a distance d relative to the case. As a result, the clamp comes into contact with the portion 2*a*'. This contact modifies the bearing points of the clamp, which particularly makes it possible to increase the restoring force of the clamp while preventing the plastic deformation thereof, in particular via a minimized axial displacement of the movement due to the increase in the restoring force. The geometry of the portion 2*a*' thus gives the clamp at least a second stiffness that it can keep until the release of the elastic restoring force of said clamp, i.e. while the clamp is in contact with the portion 2*a*'. Moreover, the portion 2*a*' makes it possible to distribute the stresses over a greater surface of the clamp and thus avoid concentrations of stresses that are excessive, which can exceed the elastic limit of the material from which the clamp is produced.

When changing from the configuration of FIG. 3 to that of FIG. 4, the bending length Lf of the clamp can vary, and it can be particularly between La/4 (FIG. 4) and La/1.5 (FIG. 3). In particular, the length Lf in this case can suddenly vary from La/1.5 to La/4 between the configuration of FIG. 3 and the configuration of FIG. 4. The mode of loading the clamp can also be suddenly modified by changing from a configuration similar to that of an embedded beam to a configuration similar to that of a four-point bending beam.

The angle α is preferentially strictly less than 45°, or less than 20°, or less than 15°, or less than 10°. This angle α is preferentially greater than 1°, particularly greater than 2°. Thus, the portion 2*a*' should be differentiated from a simple bevel resulting from the manufacture of the surface 2A. The portion 2*a*' can, moreover, occupy all or part of the surface 2A.

Of course, it is possible to press the clamp against the portion 2*a*' upon assembly, i.e. when assembling or when fixing the movement within the case, namely when the distance d separating the movement and the case is zero. The advantage of such a configuration is increasing the restoring force produced by the clamp upon assembling the movement, without causing stresses than can result in a residual deformation of the clamp.

Thus, the bearing force or the contact of the first bent end 12 of the clamp against the movement is modified when the movement is fixed to the watch case element or displaced relative to the watch case element from a rest position in which the first surface 2*b* of the movement abuts against the second surface 3*b* of the case element.

In this first embodiment, the device for modifying the stiffness of the at least one clamp comprises the portion 2*a*'. The portion 2*a*' is, for example, planar.

Figure 5:
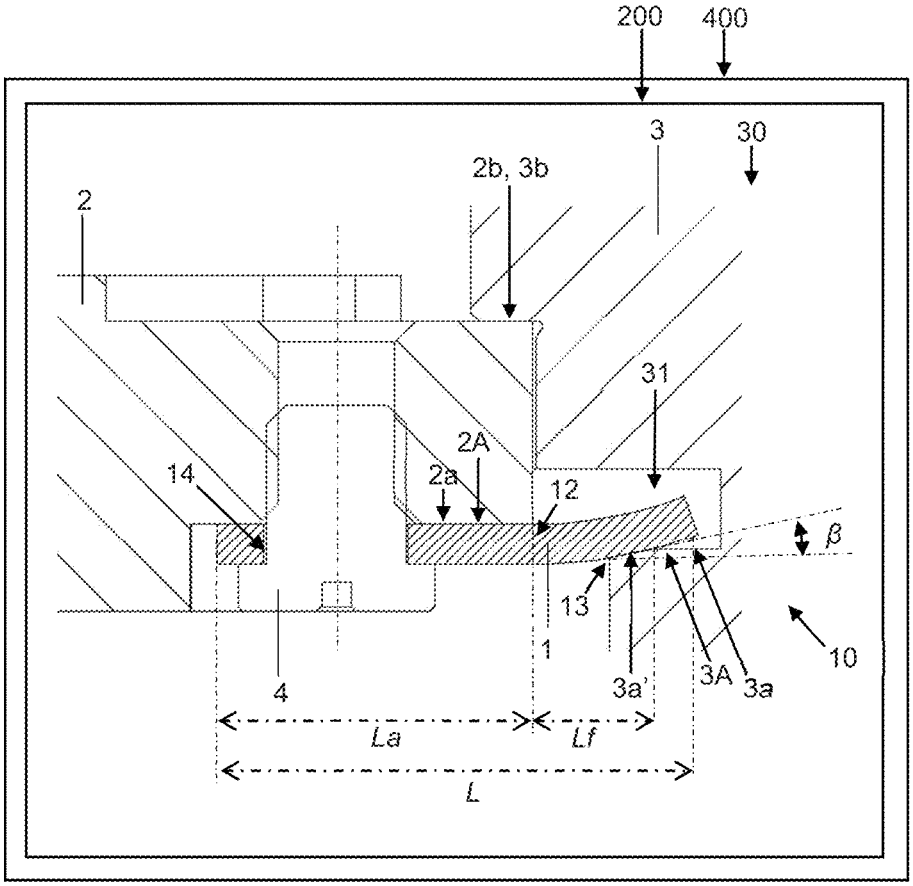
FIGS. 5 and 6 are views of a second embodiment of a timepiece in two states.
Figure 6:
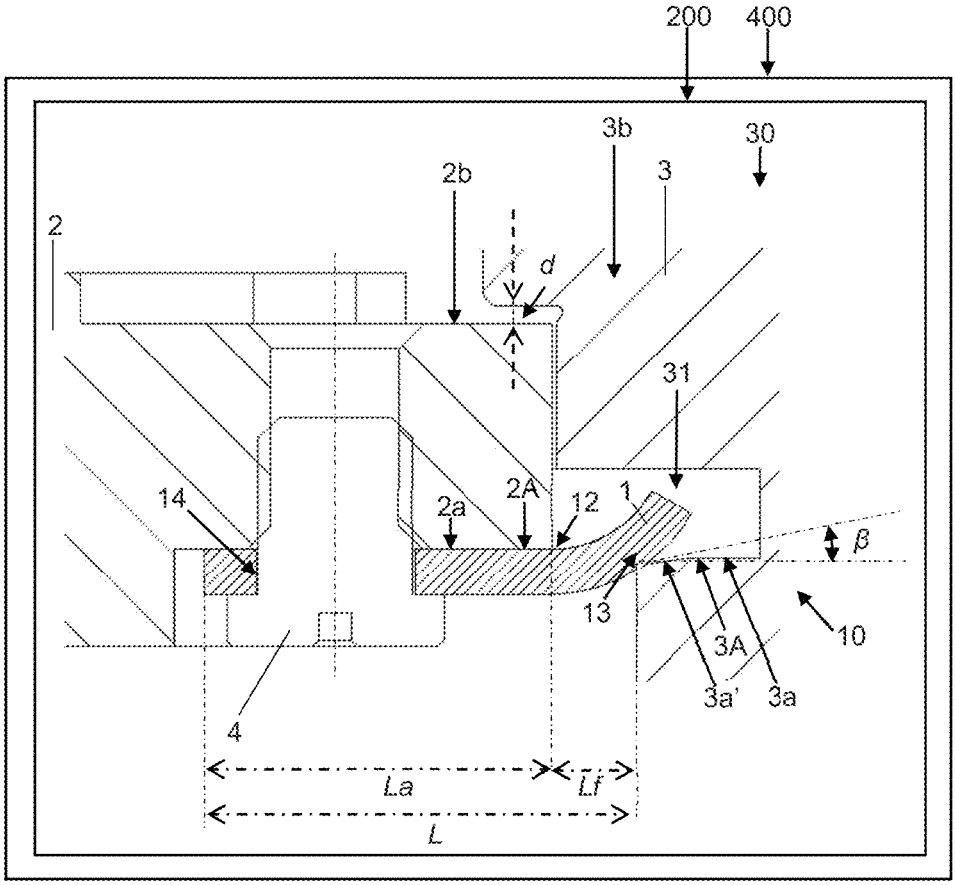

A second embodiment of a timepiece 400 is described hereafter with reference to FIGS. 5 and 6. According to the second embodiment, the timepiece can be differentiated from that of the first embodiment only by the device for modifying the stiffness of the at least one clamp.

In the second embodiment, the bearing surface 3A of the case includes at least one surface portion 3*a*' forming an angle β with the frame of the movement or with a plane perpendicular to the axis A1 of the movement.

This portion 3*a*' is adjacent to a portion 3*a* against which the clamp rests in the rest position of the movement or when fixing the movement in the case. The portion 3*a* is, for example, planar and is, for example, perpendicular to the axis A1 of the movement. Thus, the surface 3A portion 3*a*' forms an angle β with the surface 3A portion 3*a*.

When assembling the movement 2 within the case 30, the clamp 1 is elastically deformed by contact with all or part of the surface 3A under the action of the screw 4. The clamp is elastically deformed over an axial distance of interference corresponding to the interference of matter between the clamp and the case before elastic deformation of the clamp. Once the movement has been cased, the clamp is pressed against the surface 2A and held in a pre-tension state via the screw 4. In the various configurations, the bending length Lf of the clamp is particularly defined by the geometry of the surface 3A. Within the specific construction illustrated in FIG. 5, Lf~La/2.5, which gives the clamp a first stiffness that it keeps until the clamp comes back into contact with the portion 3*a*', particularly during an impact having an intensity greater than a threshold given value. When this threshold value is reached, as shown in FIG. 6, the movement is displaced axially by a distance d relative to the case. As a result, the clamp comes into contact with the portion 3*a*'. This contact modifies the bearing points of the clamp, which particularly makes it possible to increase the restoring force of the clamp while preventing the plastic deformation thereof, in particular by a minimized axial displacement of the movement due to the increase in the restoring force. The geometry of the portion 3*a*' thus gives the clamp at least a second stiffness that it can keep until the release of the elastic restoring force of said clamp, i.e. while the clamp is in contact with the portion 3*a*'.

When moving from the configuration of FIG. 5 to that of FIG. 6, the bending length Lf of the clamp can vary, and it can particularly be between La/4 (FIG. 6) and La/2.5 (FIG. 5). In particular, the length Lf in this case can vary from La/2.5 to La/4 between the configuration of FIG. 5 and the configuration of FIG. 6.

The angle β is preferentially strictly less than 45°, or less than 20°, or less than 15°, or less than 10°. This angle β is preferentially greater than 1°, particularly greater than 2°. Thus, the portion 3*a*' should be differentiated from a simple bevel resulting from the manufacture of the surface 3A. The portion 3*a*' can, moreover, occupy all or part of the surface 3A.

Of course, it is possible to press the clamp against the portion 3*a*' upon assembling the movement within the case, namely when the distance d separating the movement and the case is zero. The advantage of such a configuration is to increase the restoring force produced by the clamp upon assembling the movement, without creating stresses that can lead to a residual deformation of the clamp.

Thus, the bearing force or the contact of the second bent end 13 of the clamp against the case element is modified when the movement is fixed to the watch case element or displaced relative to the watch case element from a rest position in which the first surface 2*b* of the movement abuts against the second surface 3*b* of the case element.

In this second embodiment, the device for modifying the stiffness of the at least one clamp comprises the portion 3*a*'. The portion 3*a*' is, for example, planar.

Figure 14:
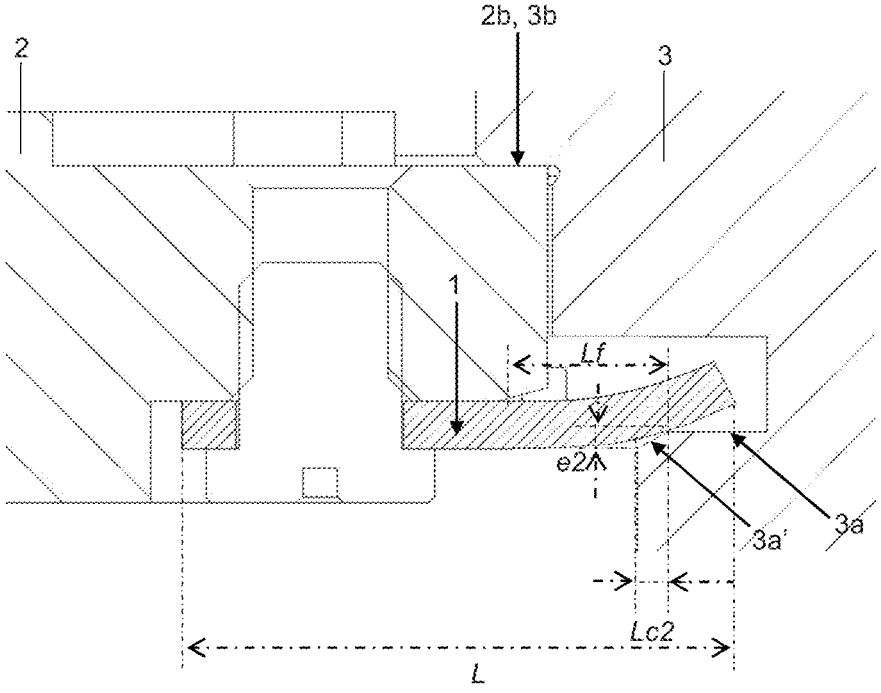
FIG. 14 is a view of a third embodiment of a timepiece in a rest position.

A third embodiment of a timepiece 400 is described hereafter. This embodiment is shown in FIG. 14. It combines the first embodiment and the second embodiment. Thus, in this third embodiment, the device for modifying the stiffness of the at least one clamp comprises an inclined portion on the movement, which portion is intended to engage the at least one clamp (particularly like the portion 2*a*' of the first embodiment shown in FIGS. 3 and 4) and an inclined portion on the case element intended to engage the at least one clamp (particularly like the portion 3*a*' of the second embodiment shown in FIGS. 5 and 6).

Thus, the bearing force or the contact of the first bent end 12 of the clamp against the movement and the bearing force or the contact of the second bent end 13 of the clamp against the case element are modified when the movement is fixed to the watch case element or displaced relative to the watch case element from a rest position in which the first surface 2*b* of the movement abuts against the second surface 3*b* of the case element.

In the various embodiments, a device for modifying the clamp stiffness is advantageously provided at each clamp. Preferably, in a same timepiece, the devices for modifying the clamp stiffness are identical for each clamp.

Figures 7, 8:
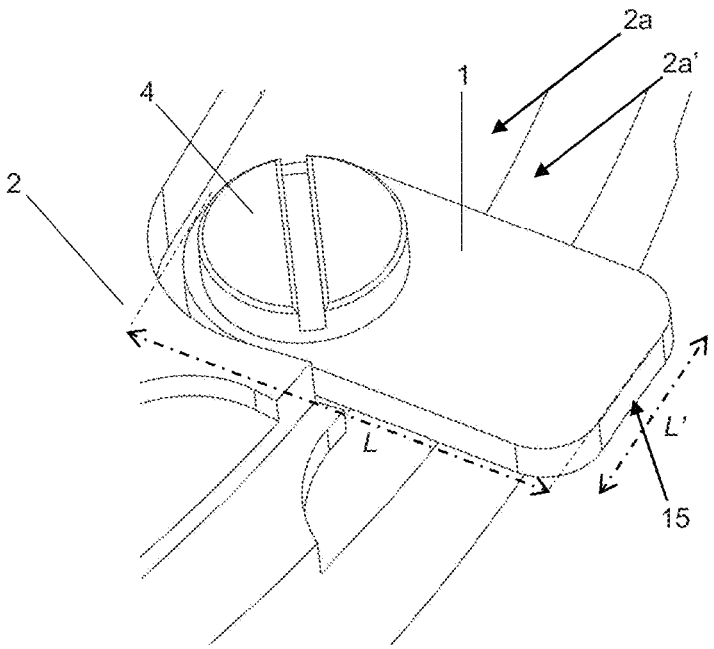
FIG. 7 is a detail perspective view of a first clamp geometry that can be used in a fixing system according to the invention.
FIG. 8 is a summary table illustrating the behavior of clamps having the same geometry in various embodiments.

Each clamp can have a parallelepiped shape or substantially a parallelepiped shape as shown in FIG. 7.

For example, one clamp can be a beam. Several or all the clamps can be beams.

For example, one clamp can have a length L according to its longitudinal direction that is at least 1.2 times or at least 1.5 times or at least 1.8 times or at least 2 times longer than its greater transverse dimension (width) L' measured according to a transverse direction that is perpendicular to the longitudinal direction. The length and the width are represented on FIGS. 7, 10 and 11. Several or all the clamps can have such a shape.

Advantageously, a clamp or each clamp comprises a cross-section S, the second moment of area of which changes along a longitudinal axis 11 of the clamp.

Figure 10:
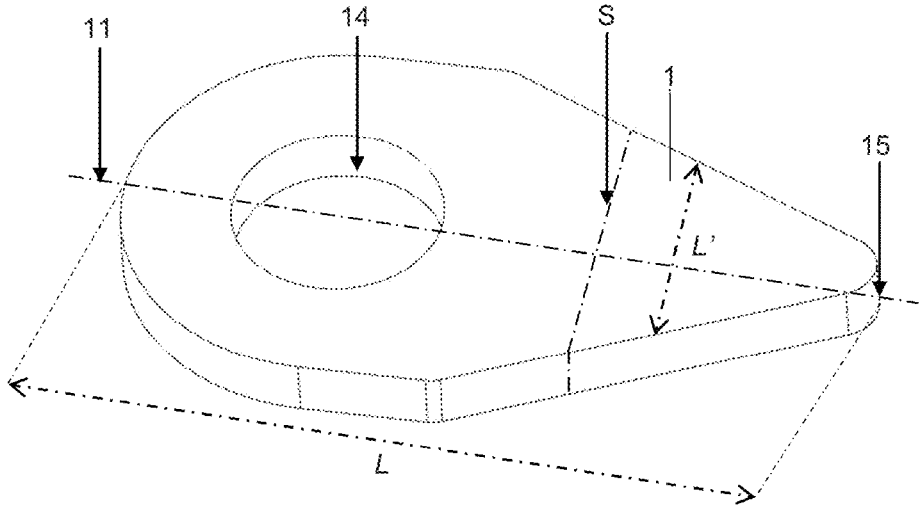
FIG. 10 is a detail perspective view of a second clamp geometry that can be used in a fixing system according to the invention.

In a first alternative shown in FIG. 10, the width L' of the clamp changes along the longitudinal axis 11. This change is present between the fixing element 14 and the end 15 of the clamp, in particular over more than half of the portion extending between the fixing element 14 and the end 15 of the clamp. The width L' decreases preferably with proximity to the end 15.

Figure 11:
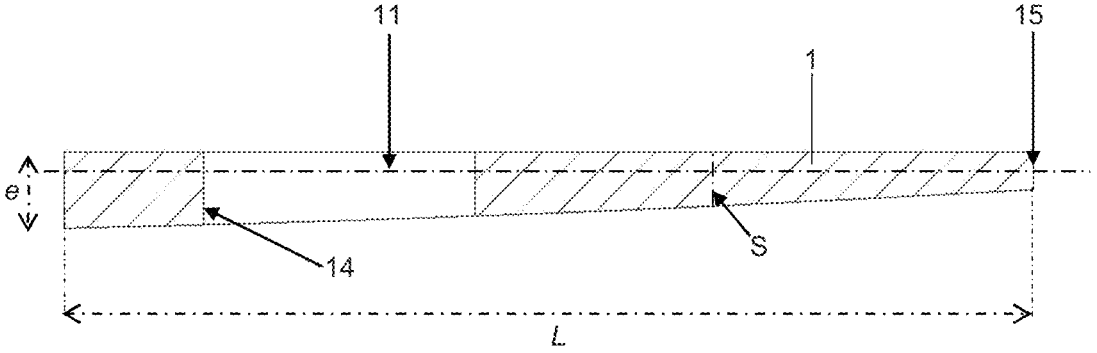
FIG. 11 is a longitudinal sectional view of a third clamp geometry that can be used in a fixing system according to the invention.

In a second alternative shown in FIG. 11, the thickness e of the clamp changes along the longitudinal axis 11. This change is present between the fixing element 14 and the end 15 of the clamp, in particular over more than half of the portion extending between the fixing element 14 and the end 15 of the clamp. The thickness e decreases preferably with proximity to the end 15.

The change in the width and/or in the thickness and/or in the geometry of the clamp can be such that the cross-sections change such that the profile of the maximum stresses in the sections is constant or substantially constant at least over part of the length of the clamp, particularly between the fixing element 14 and the end 15 of the clamp, particularly over more than half of the portion extending between the fixing element 14 and the end 15 of the clamp. In other words, the clamp can, particularly, have a profile of equal resistance to bending or "iso-stress". More generally, the sections of the clamp can change such as to optimally distribute the stresses therein, and thus minimize them.

In all of the embodiments described above, the portions 2*a*' have been described as having been produced on the movement and the portions 3*a*' have been described as having been produced on the case element.

In all of the embodiments described above, the movement is provided to be directly assembled within a middle. However, alternatively, the movement can be assembled on another case element, such as in particular a back or a bezel, provided to be added to a middle.

Of course, the timepiece unit 200 can also comprise a casing ring or an enlarging ring, wherein this casing or enlarging ring can be rigidly connected to the movement or to the middle by connected fixing means. In such a scenario, the portions 2*a*' can be produced at least partially on the casing ring or the portions 3*a*' can be produced at least partially on the casing ring.

In all of the embodiments described above, the casing clamps have been described as having been fixed on the movement. Alternatively, the fixing means for the clamps can be mounted on a casing ring. Alternatively still, the fixing means for the clamps can be mounted on a case element, particularly on a middle.

In all of the embodiments described above, the portions 2*a*' and 3*a*' have been described as planar portions.

Figure 12:
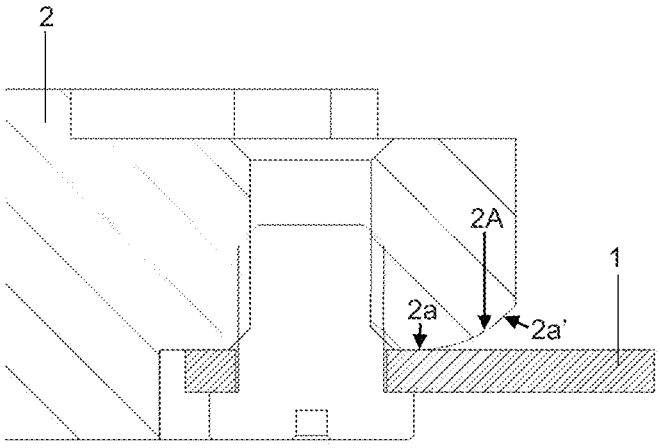
FIGS. 12 and 13 are detail views of examples of geometries of movement surfaces that are intended to engage clamps.

However, alternatively, the portion 2*a*' and/or the portion 3*a*' can be convex or rounded, particularly can have the shape of a cylinder portion, as shown in FIG. 12 with respect to the portion 2*a'*.

Figure 13:
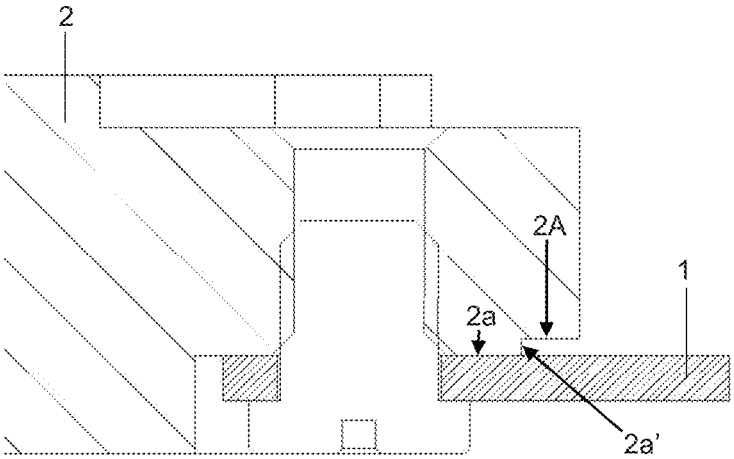

Alternatively still, the portion 2*a*' and/or the portion 3*a*' can be discontinuous, particularly be formed by a stair, as shown in FIG. 13 with respect to the portion 2*a'*.

More generally, and preferably, in the state where the movement is fixed to the case element, the movement being in the rest position in which the first surface 2*b* of the movement abuts against the second surface 3*b* of the case element, there can be a clearance e1 (FIG. 3) between the clamp and a point of the movement against which the clamp can come into contact via bending of the clamp. The value of the clearance e1 is less than Lc1, or less than Lc1/3, or less than Lc1/4 and/or the value of the clearance e1 is greater than Lc1/60, or greater than Lc1/30, with Lc1 being the length of the projection in the plane of the frame of the movement of the portion 2*a*'. Moreover, the length Lc1 is between Lf/10 and Lf with Lf measured in the rest state.

More generally, and preferably, in the state where the movement is fixed to the case element, the movement being in the rest position in which the first surface 2*b* of the movement abuts against the second surface 3*b* of the case element, there can be a clearance e2 (FIG. 14) between the clamp and a point of the case element against which the clamp can come into contact via bending of the clamp. The value of the clearance e2 is less than Lc2, or less than Lc2/3, or less than Lc2/4 and/or the value of the clearance e2 is greater than Lc2/60, or greater than Lc2/30, with Lc2 being the length of the projection in the plane of the case element of the portion 3*a*'. Moreover, the length Lc2 is between Lf/10 and Lf with Lf measured in the rest state.

Regardless of the clamp alternative, each clamp has an element 14 for fixing to the movement or to the case element. For example, this element is a passage hole 14 for the passage of a screw 4.

Regardless of the clamp alternative, the clamp can be produced from steel or from a superelastic alloy and/or from a shape memory alloy, particularly from a nickel-titanium alloy such as Nitinol or from a nickel alloy.

Regardless of the clamp alternative, the clamp 1 can be flat or not. Thus, the clamp can have a curved geometry. The clamp 1 can have an optionally symmetrical profile.

FIG. 8 illustrates a summary table reporting the behavior of clamps having the same geometry (L=3.3 mm, L'=2.05 mm, Lf=1.0 mm and e=0.35 mm) with constant sections and produced from a same material (Durnico steel) for various assembling configurations A, B, C, D.

Figure 1:
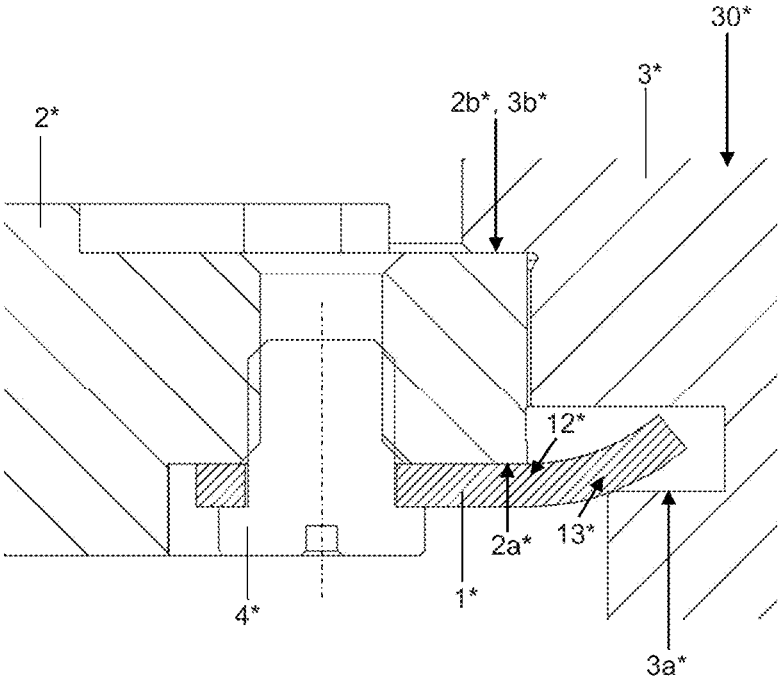
FIGS. 1 and 2 are sectional views of an assembly known from the prior art.
Figure 2:
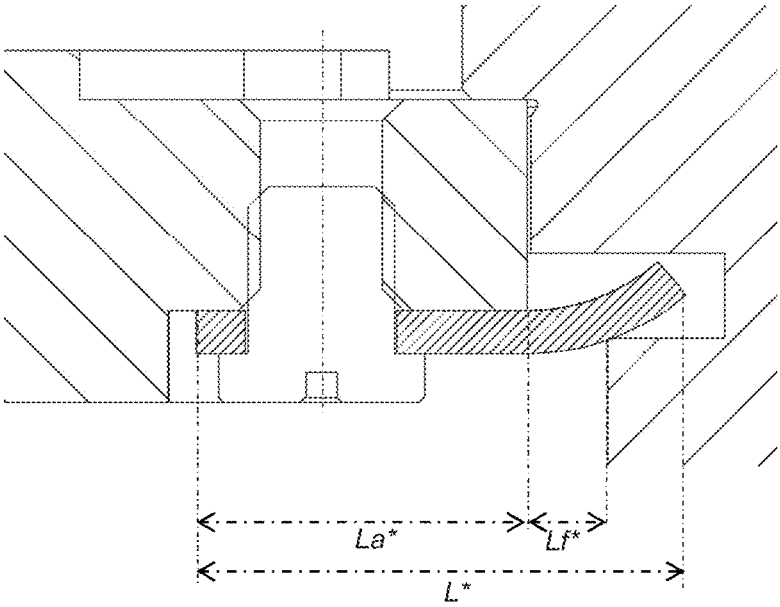

The configuration A corresponds to a prior art casing configuration illustrated by FIGS. 1 and 2.

The configuration B corresponds to the first embodiment casing configuration illustrated by FIGS. 3 and 4.

The configuration C corresponds to the second embodiment casing configuration illustrated by FIGS. 5 and 6.

The configuration D corresponds to the third embodiment casing configuration illustrated by FIG. 14.

It is noted that, for a same case—clamps interference I defining a given elastic deformation of the clamps, the elastic restoring forces F produced by the clamps, following an impact of a given intensity on the piece, vary substantially depending on the configurations. This results in axial displacements d of the movements with respect to the respective case thereof, which vary significantly, and therefore residual deformations of the clamps Def which can occur to a greater or lesser extent depending on the configurations.

The table of FIG. 8 particularly highlights the fact that the configurations B, C, D make it possible to propose a particularly stiff assembly, while minimizing the residual deformations of the clamps, whereas the clamps of the configuration A are greatly plastically deformed due to, particularly, an excessive axial displacement d produced during the impact. Given that, in this configuration Def>I, the plastic deformation of the clamp in this case causes the movement to loosen away from the middle, i.e. the loss of contact between the movement and the middle. After impact, the movement is therefore no longer assembled in a satisfactory manner in the case. Advantageously, the configuration D makes it possible to limit, to the maximum, the displacement of the movement with respect to the case and to limit the residual deformation of the clamps as far as possible.

Figure 9:
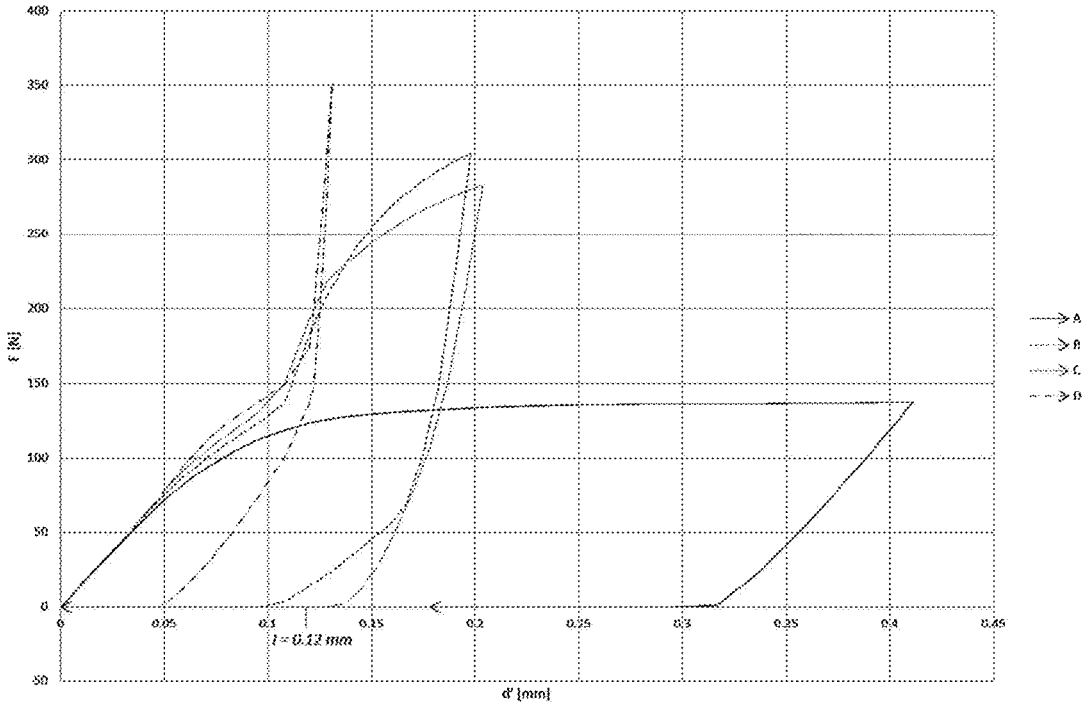
FIG. 9 is a graph illustrating the behaviors of fixing systems of FIG. 8 when the movement is displaced relative to the case.

FIG. 9 illustrates the stiffness characteristics of the clamps in each of the configurations A, B, C, D depending on the axial displacement or deformation d' thereof, where d'=d+I. Unlike the curve representing the stiffness characteristic of the clamp contributing to the configuration A, the curves representing the stiffness characteristics of the clamps contributing to the configurations B, C and D, respectively, are provided with an inflection point. This results in a first clamp stiffness particularly when assembling the movement ($d' \leq I + d_0$) and a second clamp stiffness particularly during an impact having a predefined intensity when the movement is loosened from the case by a distance d greater than do (leading to a clamp axial deformation $d'>I+d_0$), with the distance do specific to the geometry of the embodiment and able to correspond to the movement displacement causing new clamp contact with the movement or with the case element. More generally, the clamps can have a first stiffness and a second stiffness when assembling the movement within the case element or have a second stiffness once the movement has been assembled, following an impact of a predefined intensity, for example.

FIG. 9 thus highlights a modulation of stiffness of the clamps of the configurations B, C and D due to a modification of the active length thereof or a modification of the bearing points or surfaces thereof when these are strained, regardless of whether during the assembly of the movement or during an impact of the watch case after assembly of the movement.

As seen above, the clamp can be produced from steel, in particular from Durnico steel. A shape memory alloy, such as Nitinol, can advantageously be chosen for the superelastic properties thereof. A clamp formed from such an alloy has, indeed, the advantage of generating a force that varies significantly less than a clamp produced from a Durnico steel beyond a prestress given threshold, due to the change in phase of the material according to the rate of deformation thereof depending on the load to which it is subjected during casing or to which it can be subjected during an impact. This property is therefore particularly advantageous for overcoming, as best as possible, the force variations caused by the variations in assembly configurations produced by the manufacturing and/or assembling tolerances of the movement and of the case, and therefore makes it possible to propose a particularly robust assembly device.

Moreover, a clamp formed from such a superelastic alloy makes it possible to produce very large elastic restoring forces compared to those known from clamp casing devices known from the prior art. The choice of such a material is therefore particularly advantageous with the aim of increasing the casing stiffness, the advantages of which are those highlighted by means of studies by the applicant, and which are disclosed in the patent application EP2458456, i.e. particularly a remarkable decrease of the acceleration to which the movement is subjected, for example during an impact on a hard surface.

The invention also relates to a method of operating a fixing system which is the object of the invention, particularly a method of operating the embodiments described above. According to this operating method and/or in the various embodiments described above, the fixing system has an operation comprising a step of modifying the stiffness of the at least one clamp, particularly of modifying the bending stiffness of the at least one clamp, when the movement is fixed and/or the movement is displaced relative to the watch case element.

In particular, the bent length of the at least one clamp is modified, in particular the bent length of the at least one clamp is decreased, when the movement is fixed and/or when the movement is displaced relative to the watch case element from a rest position in which the first surface 2*b* of the movement abuts against the second surface 3*b* of the watch case element.

Thus, according to a second aspect of the invention, the timepiece 400, particularly a wristwatch, or the unit 200 comprises a system 10 for fixing a timepiece movement 2 to a watch case 30 element 3, the system comprising at least one clamp 1, in particular at least two clamps, preferably three clamps or four clamps, which is intended to come into contact firstly with the movement and secondly with the watch case element, the at least one clamp being made from a superelastic alloy and/or from a shape memory alloy, particularly from a nickel-titanium alloy such as Nitinol.

Nitinol is a superelastic and shape memory alloy. Indeed, in a temperature range corresponding to the use made of the clamps (−10° C. to 40° C. for example), Nitinol is in austenitic phase, therefore superelastic.

Nitinol is an alloy of nickel and titanium in which these two elements are approximately present in the same percentages, namely around 55 wt. % or 60 wt. % nickel and around 45 wt. % or 40 wt. % titanium, and possibly alloying elements, to a lesser proportion, such as chromium, cobalt, or niobium. Other shape memory alloys exist such as AuCd, CuAlBe, CuAlNi or CuZnAl in monocrystalline or polycrystalline form.

The alloys can, moreover, be subject to specific heat treatments in order to acquire the superelastic nature thereof.

For example, the alloy 60NiTi is nominally made up of 60 wt. % nickel and 40 wt. % titanium. The alloy 55NiTi is nominally made up of 55 wt. % nickel and 45 wt. % titanium. The alloy Nitinol#1 is made up of 54.5 wt. % to 57.0 wt. % nickel and between 43.0 wt. % and 45.5 wt. % titanium with a maximum of 0.25 wt. % of other elements such as chromium, cobalt, copper, iron or niobium in particular.

Figure 15:
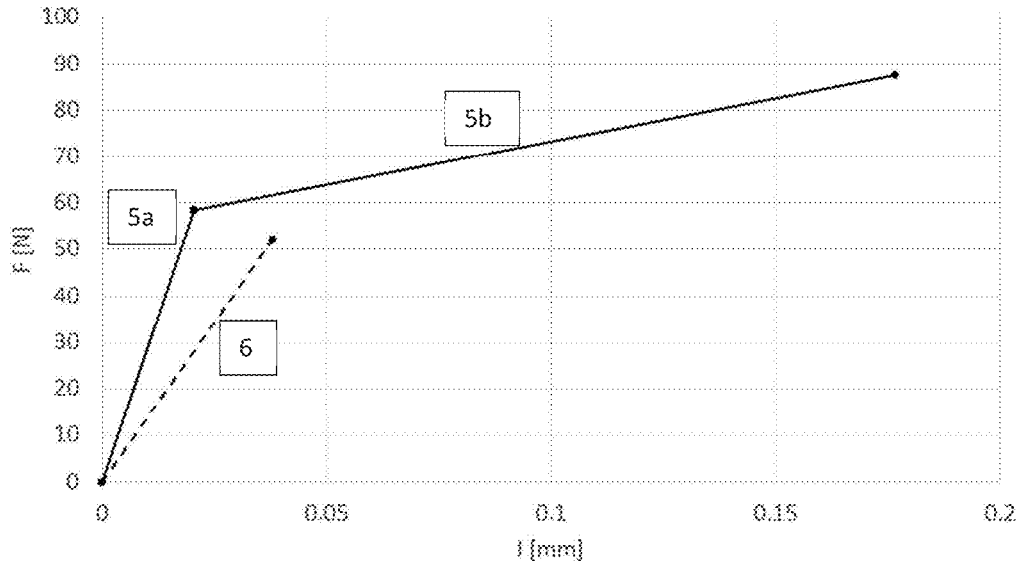
FIGS. 15 to 17 are graphs showing restoring efforts for a movement as a function of the displacement thereof relative to a case for various types of clamps.
Figure 16:
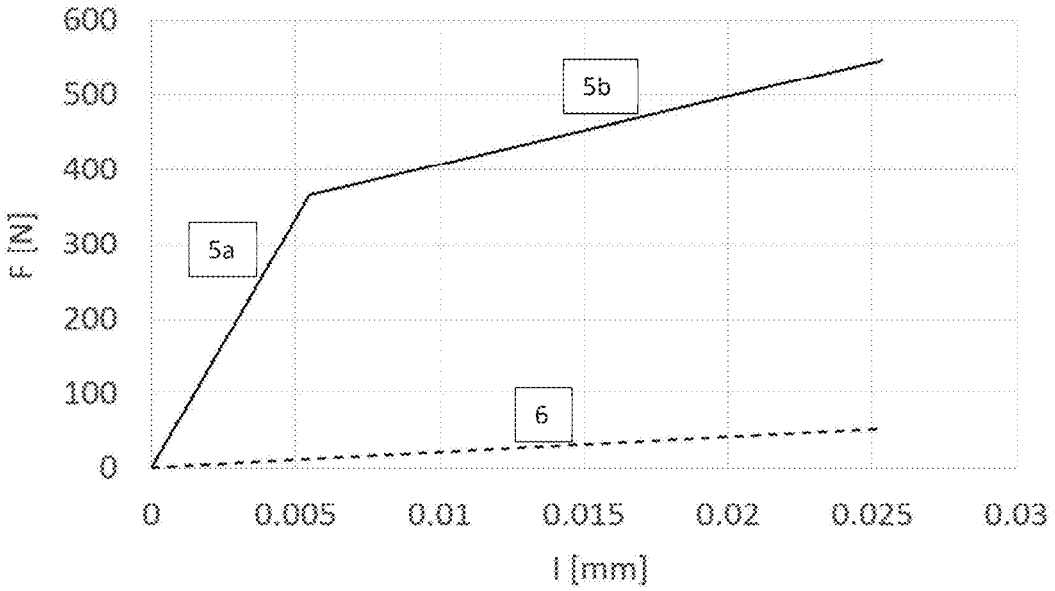
Figure 17:
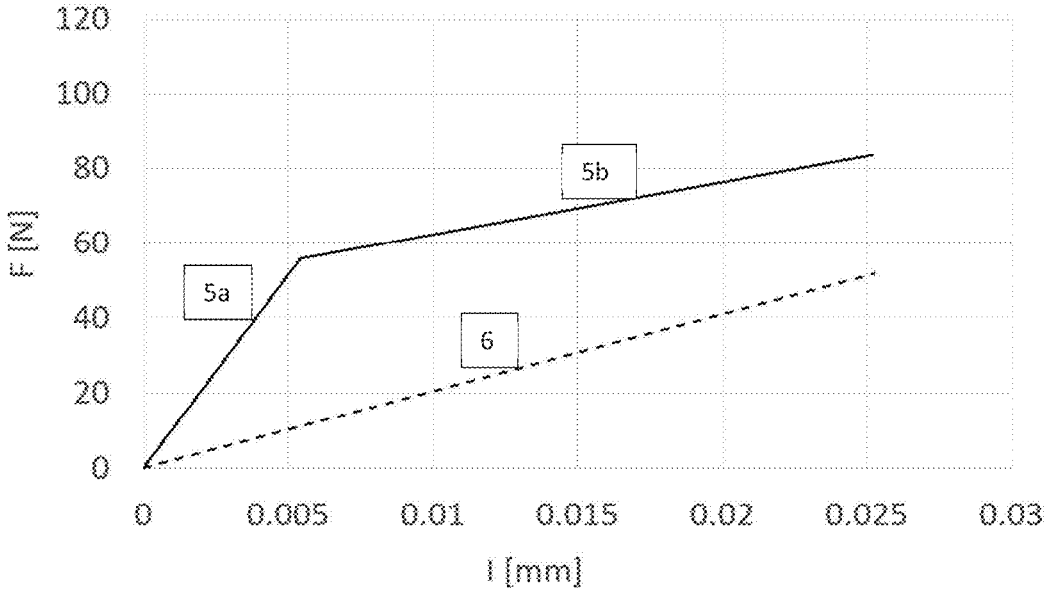

The Nitinol alloy which formed the basis for studies, the results of which are shown in FIGS. 15 to 17, is particularly made up of around 56 wt. % nickel and of around 44 wt. % titanium and of the alloying elements such as Cr, Cu, and Fe.

For example, the alloy CuAl12Be (0.45-0.68) is nominally made up of 12 wt. % aluminum and of 0.45 wt. % to 0.68 wt. % beryllium, with copper making up the remainder.

For example, the alloy CuAl13Ni4 is nominally made up of 83 wt. % copper, 13 wt. % aluminum and 4 wt. % nickel.

All of the materials stated above are suitable for producing clamps.

For example, FIG. 15 illustrates a graph showing the change in the restoring force produced by two clamps in the elastic range thereof, which clamps are made of Durnico steel (curve 6) and Nitinol (curve 5*a*, 5*b*), respectively, as a function of the "interference I" pre-tension state thereof, once the movement has been cased according to a configuration A. The "iso-stress" geometry thereof is in this case similar to that illustrated in FIG. 10 with Lf=1.35 mm and a width L' with a larger dimension of 2.05 mm. The thicknesses differ, however, with e=0.37 mm for the Durnico steel clamp and e=0.7 mm for the Nitinol clamp.

This graph shows a curve 5*a*, 5*b* including two separate portions 5*a*, 5*b* with substantially different slopes, unlike the curve 6 which only has a single limited portion. In the assembled configuration, the Nitinol clamp is prestressed such that it behaves according to the characteristic of the portion 5*b* of the curve. Thus, for an interference given variation, the variation in force produced by a Nitinol clamp is minimized with regard to that which a Durnico steel clamp can produce.

To stiffen casing as best as possible and contain the superelastic nature of the alloy in the casing phase, it will be possible to change the geometry of a Nitinol clamp with regard to the clamps known from the prior art. It will be possible, for example, to increase the thickness e of a Nitinol clamp compared to that of a clamp made of Durnico steel, and/or to minimize the bending length Lf, which is optionally constant as a function of the load.

Preferentially, e≥0.5 mm for a Nitinol clamp.

Preferentially, Lf≤1.35 mm for a Nitinol clamp.

For example, FIG. 16 illustrates a graph showing the change in the restoring force produced by two clamps, respectively, in the elastic range thereof, which clamps are made from Durnico steel (curve 6) and Nitinol (curve 5*a*, 5*b*), respectively, as a function of the "interference I" pre-tension state thereof, once the movement has been cased according to a configuration A. The "iso-stress" geometry thereof is in this case similar to that of FIG. 10 with Lf=1.35 mm and a width L' with a greater dimension of 2.05 mm. The thicknesses differ, however, with e=0.37 mm for the Durnico steel clamp and e=1.75 mm for the Nitinol clamp.

In this case, an elastic restoring force that is considerably increased compared to that produced by a Durnico steel clamp is observed, and without the risk of residual deformation of the Nitinol clamp.

To limit the increase in thickness of the clamp, it is possible, at the same time, to decrease the length Lf of the clamp. For example, FIG. 17 illustrates a graph showing the change in the restoring force produced by two clamps, respectively, in the elastic range thereof, which clamps are made from Durnico steel (curve 6) and Nitinol (curve 5*a*, 5*b*), respectively, as a function of the "interference I" pre-tension state thereof, once the movement has been cased according to a configuration A. The "iso-stress" geometry thereof is in this case similar to that of FIG. 10 with a width L' with a greater dimension of 2.05 mm. The thicknesses differ, however, with e=0.37 mm for the Durnico steel clamp and e=0.5 mm for the Nitinol clamp. The lengths Lf also differ with Lf=1.35 mm for the Durnico steel clamp and Lf=0.72 mm for the Nitinol clamp.

An elastic restoring force that is considerably increased compared to that produced by a Durnico steel clamp is observed, and without the risk of residual deformation of the Nitinol clamp. Moreover, for an interference given variation, the variation in force produced by a Nitinol clamp is minimized compared to that which a Durnico steel clamp can produce. Thus, according to the second aspect of the invention, the system has the feature of implementing casing that is particularly stiff and largely insensitive to the variations in manufacturing and/or assembling tolerances.

In the embodiment known from the prior art and shown in FIGS. 1 and 2, the bending active length Lf* of the clamp corresponds to a limited portion of the total length L* of the clamp. The length Lf* is particularly substantially less than the bearing length La* of the clamp against the movement, in particular Lf*~La*/4. This length Lf* can prove to be insufficient when assembling the movement in the case, and this risks causing a residual deformation of the clamp which can lessen the elastic restoring force potentially produced by said clamp. This scenario can particularly lead to the loss of the contact between the surfaces 2*b and 3*b, which are associated with the movement 2* and the case 3*, respectively. This scenario can also reduce the efforts under the head of the screw 4*, and this can lead to a risk of untimely unscrewing of said screw 4*.

On the contrary, if the length Lf* is increased in light of these considerations, this length Lf* can then prove to be excessive once the movement has been assembled in the case, particularly with regard to a predefined threshold for resistance to impact and/or a given range of displacement of the movement, which also risks causing a residual deformation of the clamp that can lessen the elastic restoring force initially produced by said clamp.

Thus, the volume available at the interface of the movement and the case, with the materials known from the prior art being able to be chosen in order to produce the clamps, cannot therefore be sufficient in order to completely prevent the risks of residual plastic deformation of said clamps from an impact threshold given value.

Thanks to the solutions described in this document, these problems can be solved and the fixing systems can be more robust and/or more reliable, due to the materials used for the clamps and/or the geometries on which the clamps are based. Indeed, particularly according to solutions described in this document, the stiffnesses of casing elastic clamps can vary as a function of the load which is applied thereto, in particular as a function of the displacement of the timepiece movement with regard to the watch case, particularly during casing and/or during an impact.

In this document, "superelastic alloy" preferably means an alloy having a deformation at the elastic limit greater than 2%, or greater than 5%, or greater than 8%.

In this document, the weight percentages of the elements are denoted "wt. %".

The invention claimed is:

1. A system for fixing a timepiece movement to a watch case element, the system comprising:

at least one clamp, which is configured to bend due to coming into contact with a surface of the movement and with a surface of the watch case element a) when the movement is pressed under action of the screw during assembly and/or b) when the movement and the watch case element are relatively displaced in an axial direction of the movement such as to press the at least one clamp between said surface of the movement and said surface of the watch case, a fixing element that fixes a position of the clamp relative to the movement or to the watch case, and a device for modifying the bending stiffness of the at least one clamp, when the movement is pressed under action of a screw during assembly and/or displaced in an axial direction relative to the watch case element, wherein the device for modifying the stiffness of the at least one clamp is arranged so that the bent length of the at least one clamp is modified when the movement is fixed to the watch case element or displaced relative to the watch case element from a rest position in which a first surface of the movement abuts against a second surface of the case element, wherein the device for modifying the stiffness of the at least one clamp is arranged so that the bent length of the at least one clamp is modified so that the bent length of the at least one clamp is reduced when the movement is fixed to the watch case element or displaced relative to the watch case element from the rest position in which the first surface of the movement abuts against the second surface of the case element, wherein the device for modifying the stiffness of the at least one clamp is arranged so that the bent length of the at least one clamp is modified so that the bent length of the at least one clamp is reduced in response to the movement being fixed to the watch case element or displaced relative to the watch case element from the rest position in which the first surface of the movement abuts against the second surface of the case element.

2. The system as claimed in claim 1, wherein the bearing force or the contact of a first bent end of the at least one clamp against the movement and/or the bearing force or the contact of a second bent end of the at least one clamp against the case element is/are modified when the movement is fixed to the watch case element or displaced relative to the watch case element from a rest position in which a first surface of the movement abuts against a second surface of the case element.

3. The system as claimed in claim 1, wherein the device for modifying the stiffness of the at least one clamp comprises, in a state where the movement is fixed to the case element and the movement is in a rest position in which a first surface of the movement abuts against a second surface of the case element:

a first clearance between the clamp and a point of the movement against which the clamp can come into contact via bending of the clamp, the value of the first clearance being less than Lc1, and/or the value of the first clearance being greater than Lc1/60, with Lc1 being a length of a projection in the plane of the movement of a third surface against which the clamp can bear and the length Lc1 being between Lf/10 and Lf with Lf being the bent clamp length, and/or a second clearance between the clamp and a point of the case element against which the clamp can come into contact via bending of the clamp, the value of the second clearance being less than Lc2, and/or the value of the second clearance being greater than Lc2/60, with Lc2 being a length of a projection in the plane of the movement of a fifth surface against which the clamp can bear and the length Lc2 being between Lf/10 and Lf with Lf measured in a rest state.

4. The system as claimed in claim 1, wherein the device for modifying the stiffness of the at least one clamp comprises:

a third surface forming a first nonzero angle with a fourth surface against which the clamp bears when the movement is in a rest position in which a first surface of the movement abuts against a second surface of the case element, and/or a fifth surface forming a second nonzero angle with a sixth surface against which the clamp bears when the movement is in a rest position in which a first surface of the movement abuts against a second surface of the case element.

5. The system as claimed in claim 4, wherein the first angle is less than 45°, and/or is greater than 1°, and/or wherein the second angle is less than 45°, and/or is greater than 1°.

6. The system as claimed in claim 4, wherein the first surface is planar and/or the second surface is planar and/or the third surface is planar and/or the fourth surface is planar and/or the fifth surface is planar and/or the sixth surface is planar.

7. The system as claimed in claim 4, wherein the third surface is rounded, and/or the fifth surface is rounded.

8. The system as claimed in claim 7, wherein the third surface is a cylinder portion, and/or the fifth surface is a cylinder portion.

9. The system as claimed in claim 1, wherein the at least one clamp comprises a cross-section, the second moment of area of which changes along a longitudinal axis so that a profile of maximum stresses is constant or substantially constant over at least part of a length of the at least one clamp.

10. The system as claimed in claim 9, wherein the at least one clamp comprises a cross-section, the second moment of area of the cross section of the at least one clamp changes along a longitudinal axis in width and/or in thickness.

11. The system as claimed in claim 1, wherein the at least one clamp is made of a superelastic alloy and/or of a shape memory alloy and/or of a nickel alloy.

12. A timepiece unit comprising a system as claimed in claim 1.

13. The timepiece unit as claimed in claim 12, wherein the watch case element is a middle.

14. The timepiece unit as claimed in claim 12, wherein the third surface is produced on the movement and/or the fourth surface is produced on the case element.

15. The timepiece unit as claimed in claim 12, wherein the case element comprises a casing ring and/or the fourth surface is produced at least partially on a casing ring, or wherein the movement comprises a casing ring and/or the third surface is produced at least partially on a casing ring.

16. A timepiece comprising a unit as claimed in claim 12.

17. The system as claimed in claim 1, comprising at least two clamps.

18. The system according to claim 1, wherein the at least one clamp is configured to bend due to coming into contact with a surface of the movement and with a surface of the watch case element when the movement and the watch case element are relatively displaced in an axial direction of the movement such as to press the at least one clamp between said surface of the movement and said surface of the watch case.

19. The system of claim 1, further including that the device for modifying the stiffness of the at least one clamp is configured such that when the bent length of the at least one clamp is reduced, a restoring force of the clamp is increased.

* * * * *